US009677269B2

(12) United States Patent
Wright

(10) Patent No.: US 9,677,269 B2
(45) Date of Patent: Jun. 13, 2017

(54) SEISMIC CEILING SYTEM

(71) Applicant: STUDFORM PTY LTD, Mt. Gambier (AU)

(72) Inventor: Athol David Wright, Mt. Gambier (AU)

(73) Assignee: Studform Pty Ltd, Mt. Gambier, South Australia (AU)

( * ) Notice: Subject to any disclaimer, the term of this patent is extended or adjusted under 35 U.S.C. 154(b) by 0 days.

(21) Appl. No.: 14/902,976

(22) PCT Filed: Jul. 8, 2014

(86) PCT No.: PCT/AU2014/000710

§ 371 (c)(1),
(2) Date: Jan. 5, 2016

(87) PCT Pub. No.: WO2015/003216

PCT Pub. Date: Jan. 15, 2015

(65) Prior Publication Data

US 2016/0153189 A1 Jun. 2, 2016

(30) Foreign Application Priority Data

Jul. 9, 2013 (AU) ..... 2013902518
Jul. 9, 2013 (AU) ..... 2013902519

(51) Int. Cl.

| | |
|---|---|
| ***E04B 9/30*** | (2006.01) |
| ***E04B 9/18*** | (2006.01) |
| ***E04B 9/08*** | (2006.01) |
| ***E04B 9/06*** | (2006.01) |

(Continued)

(52) U.S. Cl.
CPC ..... *E04B 9/08* (2013.01); *E04B 1/98* (2013.01); *E04B 9/067* (2013.01); *E04B 9/122* (2013.01); *E04B 9/30* (2013.01)

(58) Field of Classification Search
CPC ... E04B 9/067; E04B 9/08; E04B 9/12; E04B 9/10; E04B 9/14; E04B 9/30; E04B 9/122; E04B 2009/186
See application file for complete search history.

(56) References Cited

U.S. PATENT DOCUMENTS 3,251,164 A 5/1966 Wright
3,292,332 A * 12/1966 Jahn ..... E04B 9/067 403/247

(Continued)

FOREIGN PATENT DOCUMENTS

GB 1530295 A * 10/1978 ..... E04B 9/068
WO 2007131351 11/2007

*Primary Examiner* — Christine T Cajilig
(74) *Attorney, Agent, or Firm* — Sand & Sebolt

(57) ABSTRACT

Components for a suspended ceiling subjected to seismic events including a fixed bracket and a movable bracket presenting a contiguous flat ceiling surface under normal conditions. The movable bracket is able to slide up onto the fixed bracket during a seismic event and is returned to a neutral position with the aid of a sliding clip elastically attached to a main tee or cross runner of the ceiling. A clip for joining tee members of a suspended ceiling is provided comprising two joined arms with hooks at the end of each arm. The join of the arms sits atop a main tee member and the hooks of each arm engage cross members thus securing the members together.

15 Claims, 8 Drawing Sheets

(51) Int. Cl.
*E04B 9/12* (2006.01)
*E04B 1/98* (2006.01)

(56) References Cited

U.S. PATENT DOCUMENTS

| | | | | | |
|---|---|---|---|---|---|
| 4,505,083 | A * | 3/1985 | Mieyal | E04B 9/122 | 52/476 |
| 4,559,751 | A * | 12/1985 | Rogers | E04B 9/127 | 403/346 |
| 5,195,289 | A * | 3/1993 | LaLonde | E04F 19/02 | 52/506.06 |
| 8,453,407 | B2 * | 6/2013 | Tedesco | E04B 9/127 | 52/167.1 |
| 8,615,948 | B2 * | 12/2013 | Underkofler | E04B 9/067 | 52/506.06 |
| 2005/0160696 | A1 | 7/2005 | Kelly et al. | | |
| 2009/0223146 | A1 | 9/2009 | Platt | | |
| 2010/0005747 | A1 * | 1/2010 | Tedesco | E04B 9/122 | 52/506.08 |
| 2012/0042584 | A1 * | 2/2012 | Sareyka | E04B 9/068 | 52/167.1 |
| 2013/0227908 | A1 * | 9/2013 | Gulbrandsen | E04B 9/10 | 52/665 |

* cited by examiner

SEISMIC CEILING SYTEM

FIELD OF THE INVENTION

The present invention relates generally to suspended ceilings and more specifically relates to wall brackets and clips used to construct a ceiling for handling seismic events

BACKGROUND

Suspended ceiling grids are widely used in commercial and even some residential buildings as they allow ready access to services such as air conditioning, wiring and plumbing that are located in the ceiling space. They are particularly advantageous in multi-story buildings as they allow access whilst minimizing ceiling depth.

If seismic movement was not an issue a ceiling grid could be constructed using only fixed wall angles with main tees and cross runners being fixedly attached by simple means such as fixed angle brackets, to either side of the grid extent in any building area.

To allow for some movement of opposing walls a grid can be made with the tees and cross runners attached at one end only with the free end resting upon a wall angle. In high earthquake areas a 50×50 mm wall angle is typically used to facilitate necessary grid movement. These wall angles are unsightly and traditionally unacceptable architecturally. The free end of the runners resting upon the angle produces an uneven ceiling surface that provides a harbour for dirt and bacteria. Such an arrangement is clearly unsuitable for use in clean rooms or medical facilities where a high degree of cleanliness and hygiene is required.

To maintain structural integrity during seismic events suspended ceilings incorporate 5 way bracing support at very regular intervals i.e. 4 m.times.4 m or 3.6.times.3.6 m. The braces attach the joints between cross members to the ceiling proper and in doing so significantly congest the ceiling cavity.

SUMMARY OF THE INVENTION

It is an object of the invention to provide a wall bracket that allows for seismic movement whilst providing an even ceiling surface and to provide a clip for joining tee members of a suspended ceiling system with high strength whilst minimizing intrusion of ceiling space.

In a first aspect the invention provides a wall bracket system for movably securing a suspended ceiling, comprising a fixed member for attaching to a wall including a horizontal flange and ramp portion and a floating member including a horizontal flange and ramp portion, wherein the floating member ramp portion sits atop the fixed member ramp portion and the floating member is fixedly attached to a slide which is slidably attached to a tee member of the suspended ceiling.

Preferably the floating member is movable between a first floating position in which the floating member horizontal flange is coplanar with the fixed member horizontal flange and a second floating position in which the floating member horizontal flange sits atop the fixed member ramp section.

Preferably the slide allows the tee member to slidably move between a first tee position adjacent to the movable member to a second tee position spaced apart from the movable member. Preferably the tee member comprises a flange which forms a contiguous flat surface with the floating member horizontal flange when the tee member is in the first tee position.

Preferably the slide is attached to the tee member by an elastically deformable member which biases the floating member towards the tee member.

Preferably the floating member includes a hook which engages a hook of the fixed member to prevent movement of the floating member from the first floating position when the tee member move from the first tee position to the second tee position.

In a second aspect the invention provides clip for joining tee members of a suspended ceiling, comprising first and second elongate arms, wherein a first end of the first arm is attached to the first end of the second arm and the second end of the first and second arms includes means for attaching to the tee members.

Preferably the attachment means comprises a hook.

Preferably the clip is made from an elastically deformable material.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

Reference will now be made, by way of example only, to the accompanying drawings.

DRAWING LABELS

Figure 1A:
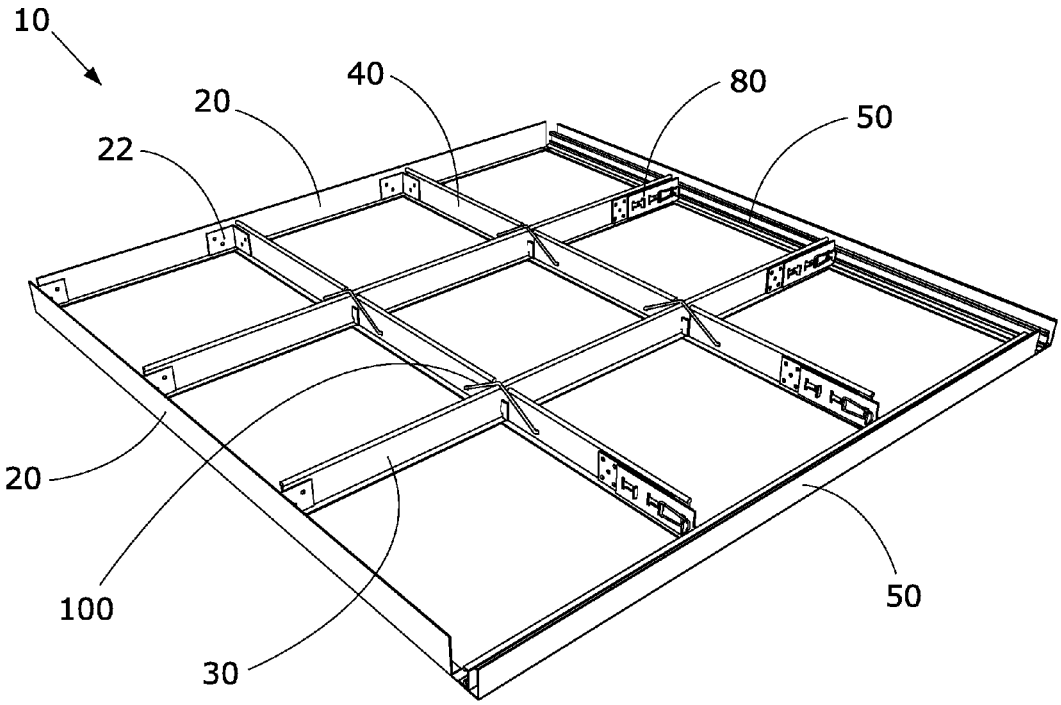
FIG. 1A shows a suspended ceiling grid incorporating a wall bracket and clip according to a preferred embodiment of the present invention.

The drawings include items labeled as follows:

10 Suspended ceiling grid
20 Fixed wall angle
22 Fixed angle bracket
30 Main Tee
33 Main Tee strengthening bulb
36 Main Tee attachment hole
40 Cross runner (Cross Tee)
41 Cross runner web
42 Cross runner horizontal flange
43 Cross runner strengthening bulb
44 Cross runner attachment finger
45 Cross runner attachment spring
46 Cross runner clip hole
47 Cross Tees mounting holes
50 Floating wall angle
60 Floating angle fixed member
61 Wall member vertical flange
62 Wall member horizontal flange
63 Wall member ramp
64 Wall member hook
65 Wall member locating groove
70 Floating angle floating member
71 Floating member vertical flange
72 Floating member horizontal flange
73 Floating member ramp
74 Floating member hook
75 Floating member locating ridge
76 Floating member clip cavity
80 Floating clip
82 Floating clip base
83 Floating clip base attachment holes
84 Floating clip base retaining tee
85 Rivets
90 Floating clip slide
91 Floating clip slide mounting slot
92 Floating clip slide sliding slot
93 Floating clip slide band anchor
94 Floating clip slide attachment tee
95 Floating clip elastic band
100 Tee clip
101 Tee clip arms
102 Tee clip hooks
200 Movement apart
201 Gap
300 Movement together

DETAILED DESCRIPTION OF THE INVENTION

The following detailed description of a preferred embodiment of the invention refers to the accompanying drawings. Wherever possible, the same reference numbers will be used throughout the drawings and the following description to refer to the same and like parts. As used herein, any usage of terms that suggest an absolute orientation (e.g. "top", "bottom", "front", "back", "horizontal", etc.) are for illustrative convenience and refer to the orientation shown in a particular figure. However, such terms are not to be construed in a limiting sense as it is contemplated that various components may in practice be utilized in orientations that are the same as, or different than those, described or shown. Dimensions of certain parts shown in the drawings may have been modified and/or exaggerated for the purposes of clarity or illustration. In particular the present invention relates to a ceiling system which inherently includes long elements with relatively small features. Such elements have been shown shortened to aid clarity.

The present invention provides a wall bracket system that can withstand seismic events and presents a contiguous flat ceiling surface wherein no component rests on top of another component and provides a clip for joining tee members of a suspended ceiling system together with high strength whilst minimizing intrusion into the ceiling space above.

FIG. 1A shows a suspended ceiling grid 10 incorporating the present invention, comprising an outer frame made of wall angles 20 and 50, main tees 30 spanning opposing wall angles and cross runners (cross tees) 40 spanning adjacent main tees and/or wall angles. Such an arrangement is similar to prior art grids and provides a regular grid for supporting ceiling tiles. In a first aspect the present invention differs from the prior art in the particulars of the wall angles 50, the clips 80 used to attach the wall angles to the tees and runners. In a second aspect the present invention differs from the prior art in the clips 100 used to secure the runners 40 to the main tees 30.

First of all it will be explained how the ceiling grid is attached to allow movement whilst still presenting a contiguous surface. The main tees 30 and cross runners 40 are fixedly secured at a first end to the wall angles 20 by means of wall angle brackets 22, and movably secured at a second end to floating wall angles 50 by means of floating clip 80. This arrangement allows the walls to which the angles 20 and 50 are attached to move with respect to each other during a seismic event whilst still maintaining the structural integrity of the ceiling grid. The integrity of the grid is further maintained by clips 100 which secure the cross runners 40 to the main tees 30.

Figure 1B:
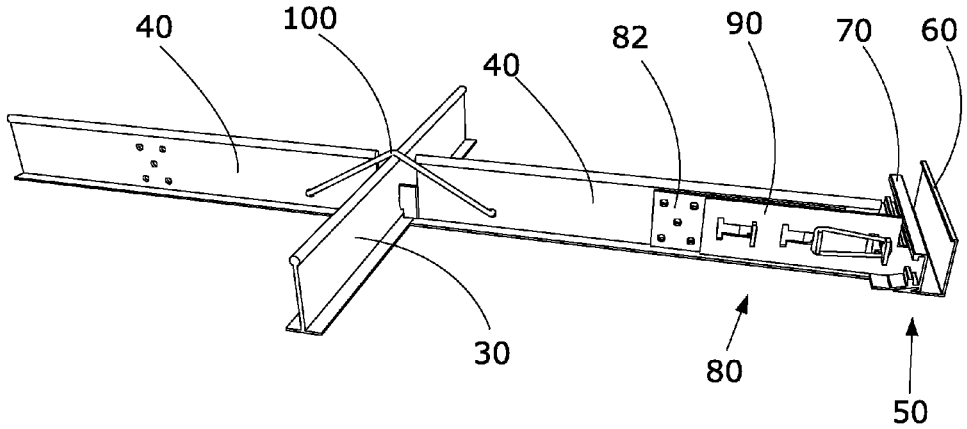
FIG. 1B shows a close up portion of the grid of FIG. 1A detailing the wall bracket and its attachment to a tee member of the grid and a clip holding tee members together

FIG. 1B shows a close up portion of the grid 10 in which can be seen that the floating wall angle 50 comprises a fixed member 60 and a floating member 70, and the clip 80 comprises a base portion 82 and sliding portion 90.

Figure 2A:
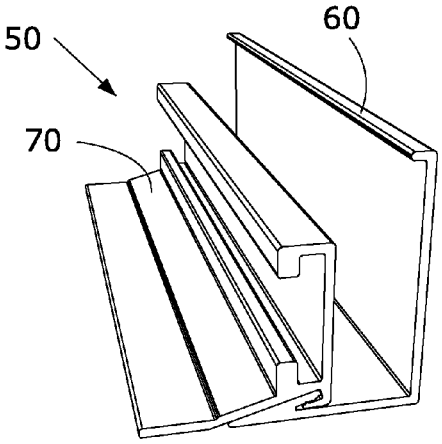
FIGS. 2A and 2B show the engagement of the fixed and floating portions of the wall bracket in perspective and side views.
Figure 2B:
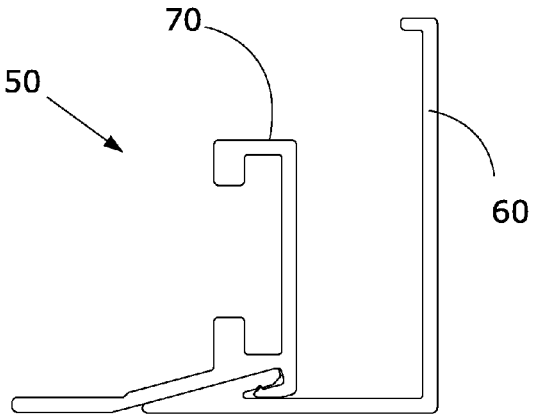
Figure 2C:
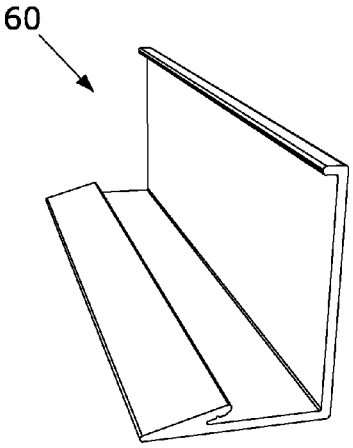
FIGS. 2C and 2D show the fixed portion of the floating wall angle in perspective and side views.
Figure 2D:
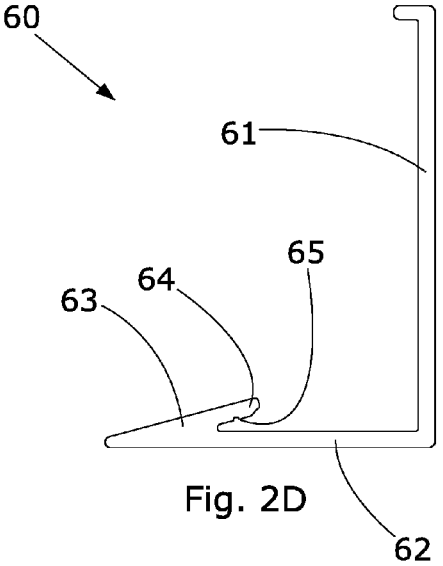
Figure 2E:
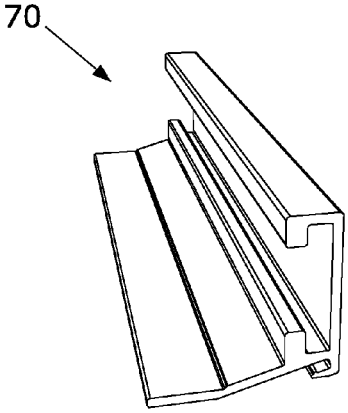
FIGS. 2E and 2F show the floating portion of the floating wall angle in perspective and side views.
Figure 2F:
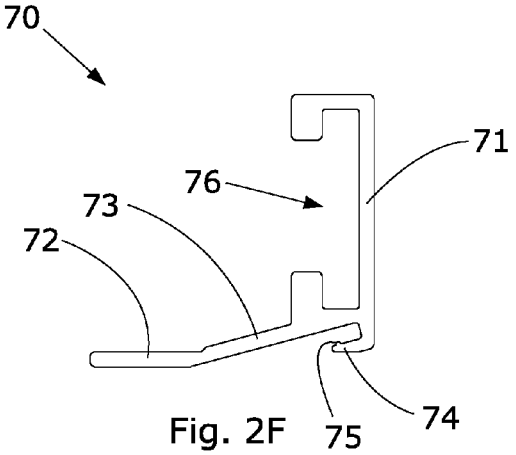

The floating wall angle 50 is shown in detail in FIGS. 2A to 2F with FIGS. 2A and 2B showing the fixed member 60 and floating member 70 fitted together in perspective and side views; FIGS. 2C and 2D show the fixed member 60 and FIGS. 2E and 2F show the floating member 70.

The fixed member 60 comprises vertical flange 61, horizontal flange 62, ramp 63 and hook 64. The ramp 63 is at an acute angle to the flange 62 thereby allowing a floating member 70 to slide over the fixed member and towards the vertical flange 61, whilst hook 65 restrains the floating member from moving away from the vertical flange.

The floating member 70 comprises vertical flange 71, horizontal flange 72, ramp 73, hook 74 and cavity 76. The ramp 73 is at an obtuse angle to the flange 71 to allow the ramp 73 to slide over the ramp 63 of the fixed member 60. The ramp 73 and hook 74 complement the ramp 63 and hook 64 of the fixed member, allowing movement in a first direction, but restricting it in a second. The cavity 76 provides a means of engaging the slide 90 of the clip 80.

The fixed member 60 and floating member 70 nominally fit together in a neutral position as shown in FIG. 2A and 2B wherein the respective horizontal flanges 62 and 72 align to form a contiguous flat surface. Alignment groove 65 of the fixed member and alignment ridge 75 of the floating member aid in aligning the two members in such a neutral position.

FIGS. 3 to 7 show details of a floating clip 90 and how it is attached to the end of a cross runner 40. The clip 90 may be attached to the end of a main tee 30 in a similar manner.

Figure 3:
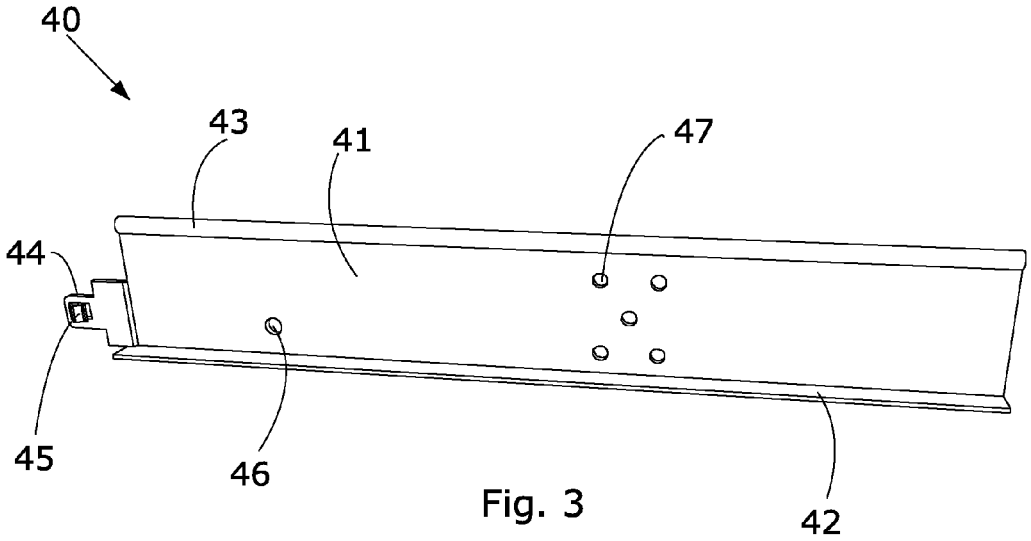
FIG. 3 shows details of a cross runner.

As seen in FIG. 3 a cross runner 40 comprises a vertical web 41 with a strengthening bulb 43 atop, opposed horizontal flanges 42 (of which only one can be seen in FIG. 3) and attachment finger 44 with attachment spring 45 for securing the cross runner to a main tee. The clip hole 46 is used for engaging a clip to secure adjacent cross runners together and to a main tee. The cross runner shown has only one attachment finger at a first end as the second end is to have a floating clip attached via mounting holes 47. Where a cross runner is to be located between two main tees it would instead have a further attachment finger 44, spring 45 and clip hole 46.

Figure 4:
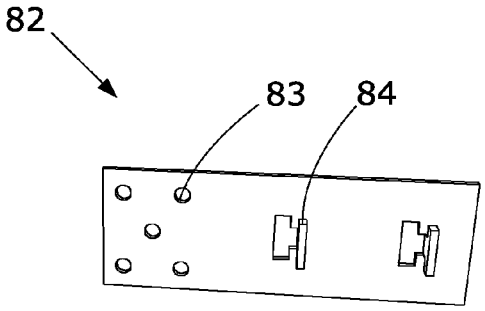
FIG. 4 shows a floating clip base.
Figure 5:
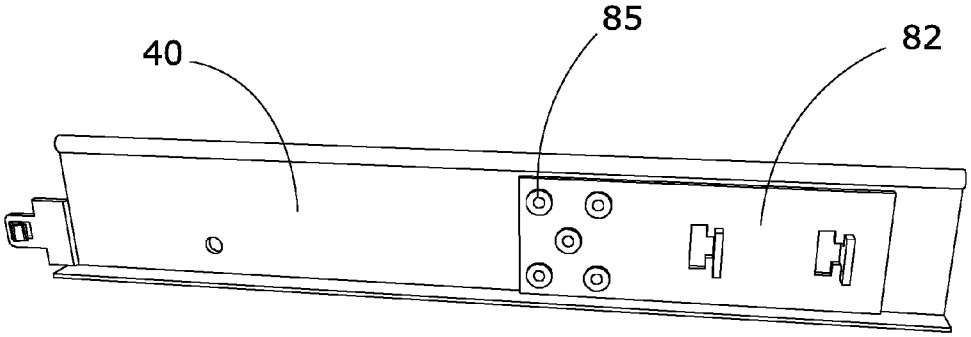
FIG. 5 shows a floating clip base attached to a cross runner

FIG. 4 shows a floating clip base 82 which provides retaining tees 84 for slidably attaching and retaining a floating clip slide 90. The base includes attachment holes 83 to facilitate attaching the clip to a cross runner by riveting. The base is shown attached to a cross runner in FIG. 5.

Figure 6:
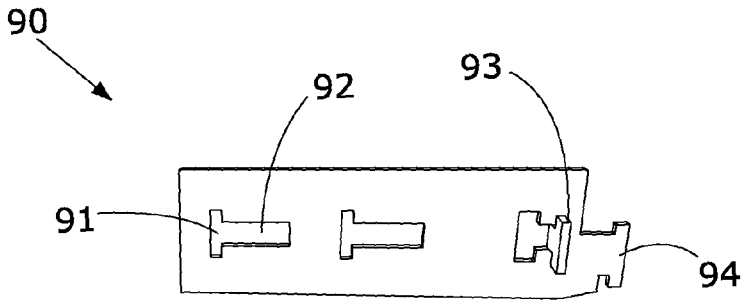
FIG. 6 shows a floating clip slide.
Figure 7:
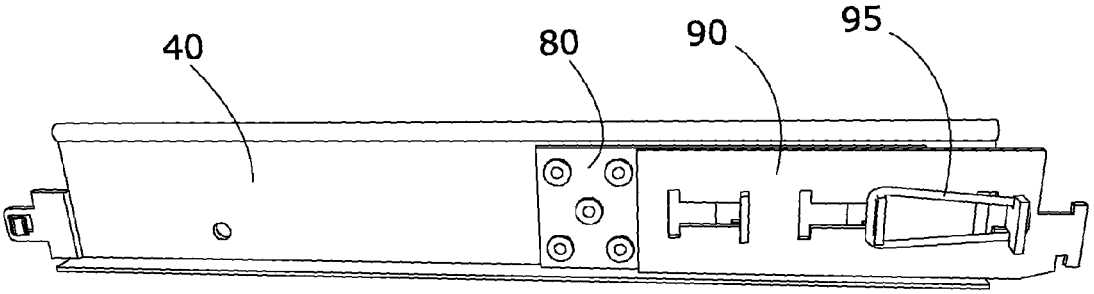
FIG. 7 shows a floating clip slide engaging a sliding clip base.

FIG. 6 shows a floating clip slide 90 comprising a body with mounting slots 91, sliding slots 92, rubber band anchor 93 and attachment tee 94 for attaching the slide to a wall angle. To fit the slide 90 to a base 82 the retaining tees 84 of the base are passed through the mounting slots 91. The slide is then able to slide back and forth on the base to the extent of the sliding slot 92. As shown in FIG. 7, a rubber band 95 is fitted between the attachment tee 94 of the slide and retaining tee 84 of the base and acts to keep the slide in a neutral position as also seen in FIG. 9.

The clip may take the form of several different embodiments. In one further embodiment the clip base is integrally formed with the cross runner or main tee. In another embodiment the rubber band is replaced with a spring. In other embodiments the retaining tee is replaced with a stud. Other embodiments are readily envisaged, all however must provide a means for fixedly attaching the clip to a wall angle and slidably attaching to a main tee or cross runner and further provide a spring means to return the clip and any attached wall angle to a neutral position following movement.

Figure 8A:
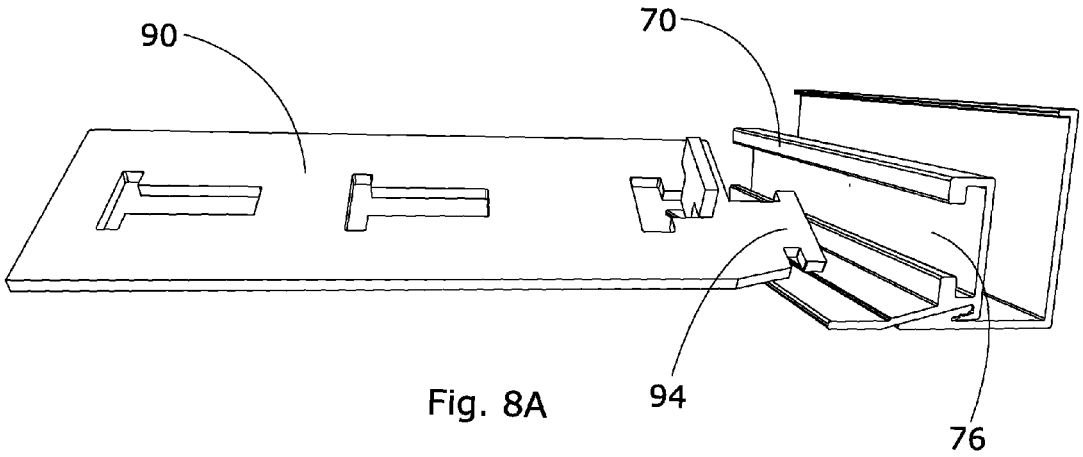
FIGS. 8A to 8C shows a floating clip slide engaging with the wall bracket.
Figure 8B:
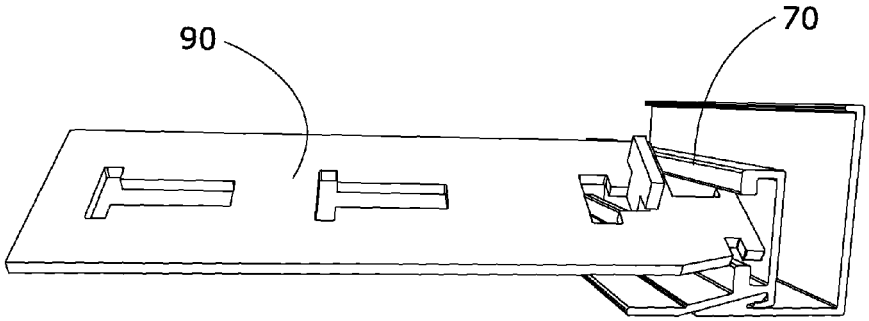
Figure 8C:
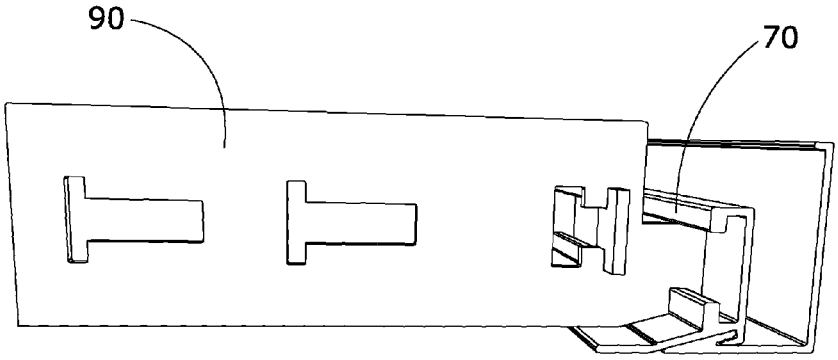

A clip slide 90 can be attached to a floating wall angle as show in FIGS. 8A to 8C. The slide may be attached either before or after fitting to a slide base. The slide is first rotated such that its attachment tee 94 may enter the floating member clip cavity 76 and then rotated so that the attachment tee engages the cavity thus firmly attaching the two elements.

Figure 9:
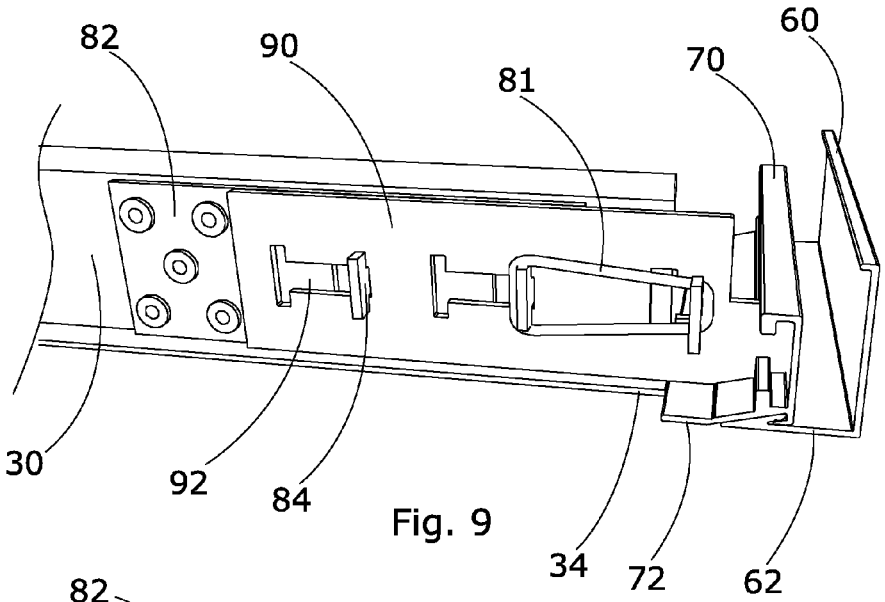
FIG. 9 details a wall bracket and clip in a neutral position.
Figure 10:
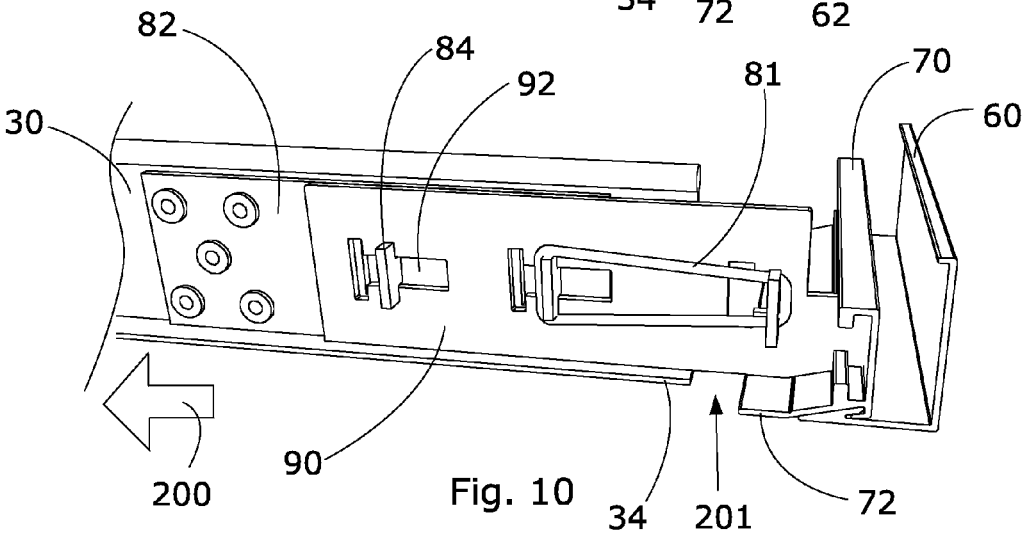
FIG. 10 details a wall bracket and clip during a seismic event wherein the walls are moving apart.
Figure 11:
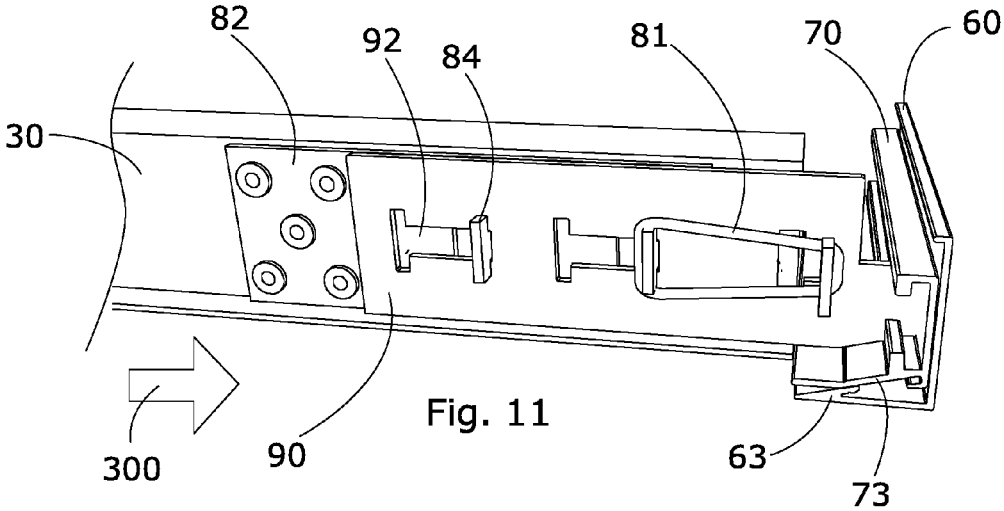
FIG. 11 details a wall bracket and clip during a seismic event wherein the walls are moving together.

Movement of the components during a seismic event can be appreciated with the aid of FIGS. 9 to 11. Before a seismic event the components provide a contiguous ceiling surface. This surface is disturbed during the event, but is restored afterwards.

FIG. 9 shows the components in a neutral position as would be the case when a ceiling grid is installed. The fixed member 60 and floating member 70 sit fit together in a neutral position in which they are maximally separated, and the slide 90 of the floating clip 80 is retracted by the elastic band 95. The respective horizontal flanges 62 and 72 of the fixed and floating member align to form a contiguous flat surface together with the horizontal flange 34 of the main tee 30. This contiguous surface is advantageous in being aesthetically pleasing as well as physically isolating a ceiling space from the room below. This is particularly desirable when in clean room situations such as hospitals.

In FIG. 10 the main tee 30 has been pulled away from the fixed member 60 as indicated by arrow 200 as would happen in a seismic event when the walls to which the main tee and fixed member move apart. The clip base 82 moves in tandem with the main tee away from the clip slide 90 which remains attached to the floating member 70. The floating member remains fixed in its neutral position as its hook 74 is engaged with the hook 64 of the fixed member 60. The elastic band 81 spanning the clip base 82 and slide 90 stretches and a gap 201 opens up between the main tee flange 34 and the floating member horizontal flange 72. When the tee returns to original position as in FIG. 9, the elastic band will act to keep the floating member in the neutral position and the gap 201 will close.

In FIG. 11 the main tee 30 has been pushed towards the fixed member 60 as indicated by arrow 300 as would happen in a seismic event when the walls to which the main tee and fixed member move towards each other. The clip base 82 moves in tandem with the main tee and as the base retaining tee 84 is at the right hand extremity of the clip sliding slot 92 the clip slide 90 also moves towards the fixed member. As the floating member 70 is attached to the clip it also moves, with its ramp 73 riding up the ramp 63 of the fixed member. When the tee returns to original position as in FIG. 9, the elastic band will act to pull the floating member back to the neutral position.

Whilst the above embodiment describes the attachment of the bracket to a wall it may equally well be attached to a post or other structure and is not intended to limit the invention to this particular embodiment.

The reader will appreciate the first aspect of the present invention which provides a seismic ceiling system that can withstand seismic events and presents a contiguous flat ceiling surface wherein no component rests on top of another component. This feature is critical in hygiene critical environments such as hospitals.

Figure 12A:
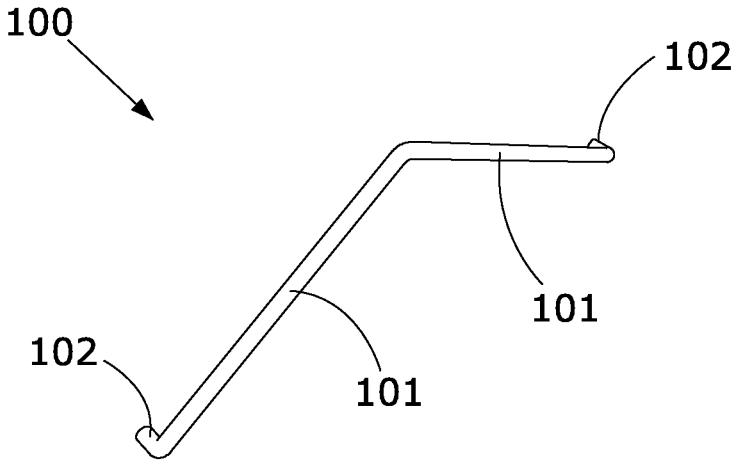
FIG. 12A shows a first perspective view of a clip for joining tee members.
Figure 12B:
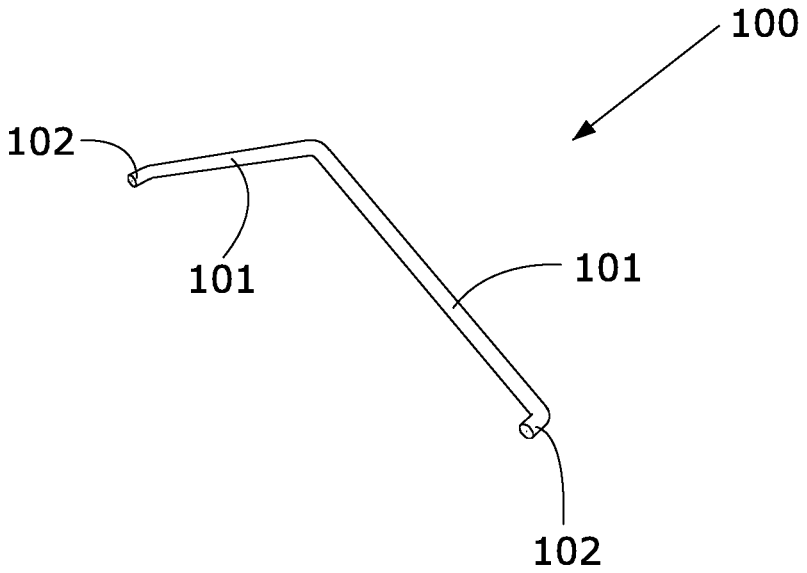
FIG. 12B shows a second perspective view of the clip.

Now to focus on the second aspect of the invention, the clip that is used to hold the tee members together. Details of a clip 100 are shown in two different perspective views in FIGS. 12A and 12B. The clip 100 comprises arms 101 disposed at approximately 120 degrees to each other and attachment means in the form of small hooks 102 at the end of each arm. The clip 100 is made of an elastically deformable material such as mild steel.

Figure 13A:
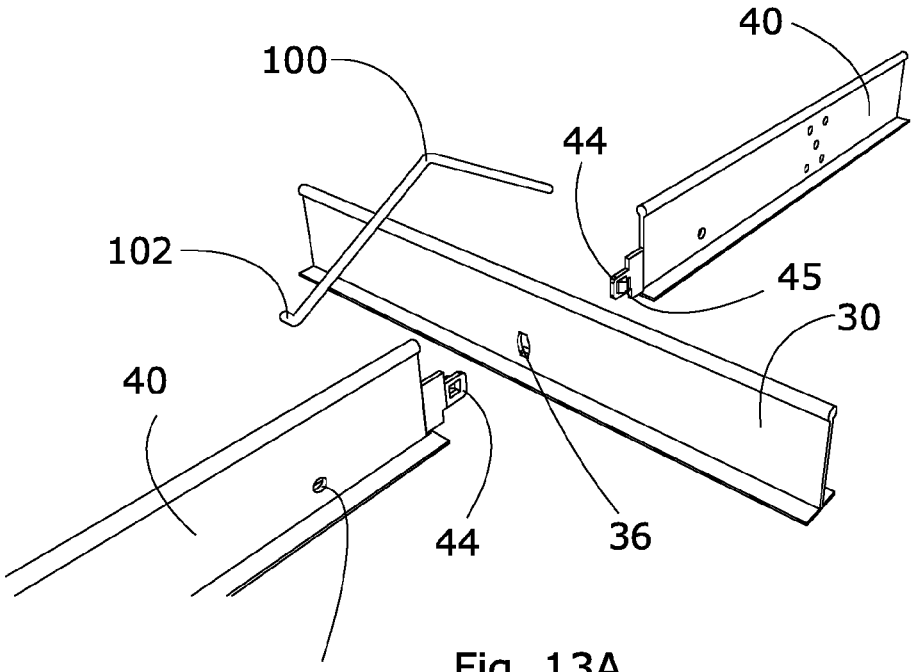
FIG. 13A shows tee members and a clip coming together to be joined.
Figure 13B:
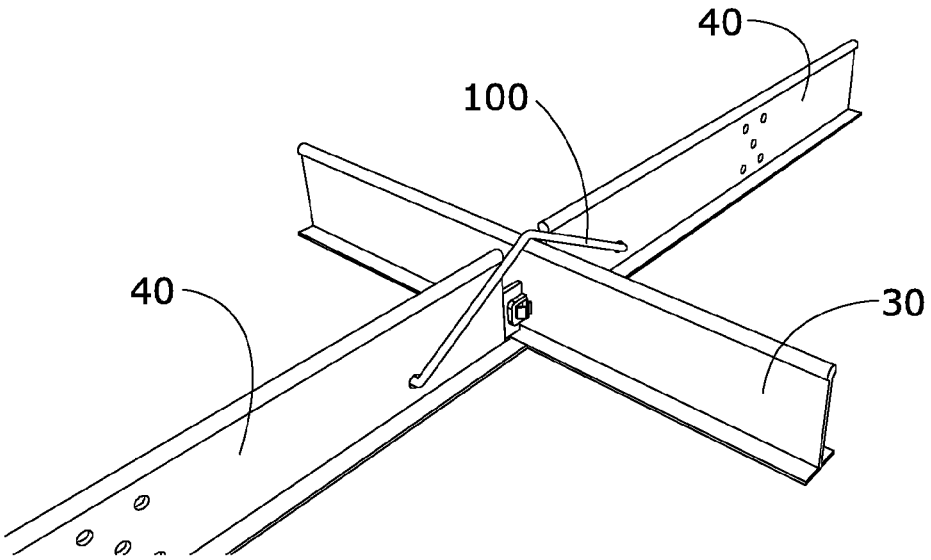
FIG. 13B shows details of tee members joined by a clip.

FIGS. 13A and 13B illustrate the joining of two cross runners 40 to a main tee 30. As is the prior art the main tee includes an attachment hole 36 into which the attachment fingers 44 of the cross runners are placed. Once in the hole, attachment springs 45 return to their resting position and lock the cross runners in place. Such a joining mechanism provides limited strength and is only capable of withstanding low force seismic events. Prior art systems often supplement such joins with extensive 5 way bracing and hence occupy a large volume of ceiling space. In the present invention clip 100 is placed on top of the strengthening bulb 33 of the main tee 30 and held in place by the clip hooks 102 engaging the clip holes 46 of the cross runner. The resulting joint is strong enough to withstand severe seismic events. The location of the holes 46 and dimensions of the clip 100 are chosen such that the clip must be flexed slightly to be fitted. The clip 100 thus acts as a spring against the top of the main tee 30 and the sides of the holes 46 holding the various components tightly together.

In further embodiments the clip attachment means can take other forms, for example a loop which can either be fixed to a cross runner by a screw or the like or simply placed over a protruding member of the cross runner such as a stud.

The reader will appreciate the second aspect of the present invention which provides a clip for joining main tees and cross runner that produces joints capable of withstanding severe seismic events whilst minimizing intrusion of ceiling space. An increased strength of 30% or more in comparison to prior art systems has been demonstrated in practical testing.

Together the brackets and the clip provide a ceiling system that is strong and flexible for handling seismic events whilst presenting a smooth ceiling and not intruding into the ceiling space.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A wall bracket system for movably securing a suspended ceiling, comprising:

a fixed member for attaching to a wall including a horizontal flange and a ramp portion; and a floating member including a horizontal flange and a ramp portion, wherein:

the floating member ramp portion sits atop the fixed member ramp portion and is in direct contact with the fixed member ramp portion; and the floating member is fixedly attached to a slide which is slidably attached to a tee member of the suspended ceiling.

2. The bracket system as in claim 1, wherein the floating member is movable between:

a first floating position in which the floating member horizontal flange is coplanar with the fixed member horizontal flange; and a second floating position in which the floating member horizontal flange sits atop the fixed member ramp section.

3. The bracket system as in claim 1, wherein the slide allows the tee member to slidably move between a first tee position adjacent to the floating member and a second tee position spaced apart from the floating member.

4. The bracket system as in claim 3, wherein the tee member comprises a flange which forms a contiguous flat surface with the floating member horizontal flange when the tee member is in the first tee position.

5. The bracket system as in claim 1, wherein the slide is attached to the tee member by an elastically deformable member which biases the slide and floating member towards the tee member.

6. The bracket system as in claim 3, wherein the floating member includes a hook which engages a hook of the fixed member to prevent movement of the floating member from the first floating position when the tee member moves from the first tee position to the second tee position.

7. A wall bracket system for movably securing a suspended ceiling, comprising:

a fixed member for attaching to a wall including a horizontal flange and a ramp portion; and a floating member including a horizontal flange and a ramp portion, wherein the floating member ramp portion sits atop the fixed member ramp portion and the floating member is fixedly attached to a slide which is slidably attached to a tee member of the suspended ceiling; and wherein the floating member is movable between:

a first floating position in which the floating member horizontal flange is coplanar with the fixed member horizontal flange; and a second floating position in which the floating member horizontal flange sits atop the fixed member ramp section.

8. The bracket system as in claim 7, wherein the slide allows the tee member to slidably move between a first tee position adjacent to the floating member and a second tee position spaced apart from the floating member.

9. The bracket system as in claim 8, wherein the tee member comprises a flange which forms a contiguous flat surface with the floating member horizontal flange when the tee member is in the first tee position.

10. The bracket system as in claim 8, wherein the slide is attached to the tee member by an elastically deformable member which biases the slide and floating member towards the tee member.

11. The bracket system as in claim 8, wherein the floating member includes a hook which engages a hook of the fixed member to prevent movement of the floating member from the first floating position when the tee member moves from the first tee position to the second tee position.

12. A wall bracket system for movably securing a suspended ceiling, comprising: a fixed member for attaching to a wall including a horizontal flange and a ramp portion; and a floating member including a horizontal flange and a ramp portion, wherein the floating member ramp portion sits atop the fixed member ramp portion and the floating member is fixedly attached to a slide which is slidably attached to a tee member of the suspended ceiling; and wherein the slide allows the tee member to slidably move between a first tee position adjacent to the floating member and a second tee position spaced apart from the floating member.

13. The bracket system as in claim 12, wherein the tee member comprises a flange which forms a contiguous flat surface with the floating member horizontal flange when the tee member is in the first tee position.

14. The bracket system as in claim 12, wherein the slide is attached to the tee member by an elastically deformable member which biases the slide and floating member towards the tee member.

15. The bracket system as in claim 12, wherein the floating member includes a hook which engages a hook of the fixed member to prevent movement of the floating member from the first floating position when the tee member moves from the first tee position to the second tee position.

* * * * *